US008240318B2

(12) United States Patent
Choi

(10) Patent No.: US 8,240,318 B2
(45) Date of Patent: Aug. 14, 2012

(54) HAIR CLIP

(75) Inventor: Jin Ho Choi, Dongducheon-si (KR)

(73) Assignee: Haejeong Min, Aliso Viejo, CA (US)

( * ) Notice: Subject to any disclaimer, the term of this patent is extended or adjusted under 35 U.S.C. 154(b) by 182 days.

(21) Appl. No.: 12/841,143

(22) Filed: Jul. 21, 2010

(65) Prior Publication Data

US 2011/0023905 A1 Feb. 3, 2011

(30) Foreign Application Priority Data

Jul. 31, 2009 (KR) ..... 20-2009-0010034 U

(51) Int. Cl.
*A45D 8/20* (2006.01)

(52) U.S. Cl. ..... 132/277

(58) Field of Classification Search ..... 132/273–279
See application file for complete search history.

(56) References Cited

U.S. PATENT DOCUMENTS

| | | | | |
|---|---|---|---|---|
| 2,849,008 | A * | 8/1958 | Otten | 132/277 |
| 7,631,648 | B2 * | 12/2009 | Kirby | 132/276 |
| 2009/0194131 | A1 * | 8/2009 | Kim | 132/277 |
| 2009/0229626 | A1 * | 9/2009 | Hsu | 132/277 |

* cited by examiner

*Primary Examiner* — Rachel Steitz
(74) *Attorney, Agent, or Firm* — Cantor Colburn LLP

(57) ABSTRACT

A hair clip is provided. An upper clip includes a first body, a first pressing unit for separating the upper clip and a lower clip, and a first bracket having a first through hole. The lower clip includes a second body, a second pressing unit configured to separate the upper clip and the lower clip when a clamping force is applied thereto, and a second bracket having a second through hole, the second bracket being positioned on an upper portion of the second pressing unit of the lower clip. A fixing member having an elasticity has a first end coupled with the first body of the upper clip and a second end coupled with the first pressing unit of the upper clip. The spring provides an elastic force while pressing the upper clip. The hinge connects the upper and lower clips with the spring.

6 Claims, 9 Drawing Sheets

HAIR CLIP

CROSS-REFERENCE TO RELATED APPLICATIONS

The present application claims priority under 35 U.S.C. 119 of Korean Patent Application No. 20-2009-0010034, filed on Jul. 31, 2009, the disclosure of which is expressly incorporated by reference herein in its entirety.

BACKGROUND OF THE INVENTION

1. Field of the Invention

The present invention relates to a hair clip, and more particularly to a hair clip for holding or retaining a strand of a hair in a particular style, wherein the hair clip has an improved structure in which a separated hair is securely held in place so that the hair may not easily fall off from the hair clip, thereby facilitating hair styling, while the hair clip may not leave a mark on the hair during or after the hair styling and the hair may be easily sectioned off without a need to separate upper and lower clips by using the extended lower clip.

2. Description of the Related Art

Generally, hair clips are used to separate a hair for work at home or a hair salon to tame or style the hair, for example, hair cutting or hair coloring. The hair clips have an elongated arm to clip the hair.

Referring to FIG. 1, a conventional hair clip 10 includes an upper clip 11 and a lower clip 21. Each of the upper and lower clips 11 and 21 has a curvature at a head portion thereof. The upper clip 11 includes a curved part 11-1, a supporting part 11-2 and a bracket 11-3 positioned between the curved part 11-1 and the supporting part 11-2. The curved part 11-1, the supporting part 11-2 and the bracket 11-3 are integrally formed with each other to provide the upper clip 11.

The lower clip 21 has a shape that corresponds to that of the upper clip 11. The lower clip 21 includes a curved part 21-1, a supporting part 21-2 and a bracket 21-3 positioned between the curved part 21-1 and the support part 21-2. The curved part 21-1, the supporting part 21-2 and the bracket 21-3 are integrally formed with each other to provide the lower clip 21.

A rivet R is installed by inserting the rivet R through a connection hole formed on each of the brackets 11-3 and 21-3. A spring S is positioned on the axis of the rivet R so that the upper clip 11 and the lower clip 21 are opened by complimentary finger grips.

The distance between the curved part 11-1 of the upper clip 11 and the curved part 21-1 of the lower clip 21 increases along the direction toward the supporting part 21-2 depending on a method of formation and installation of the brackets 11-3 and 21-3 (see "A" in FIG. 1).

Since the prior art hair clip 100 has the elongated curved parts 11-1 and 21-1, the prior art hair clip 100 has the following disadvantages in separating and holding the hair.

Front end portions of the curved parts 11-1 and 21-1 of the upper and lower clips 11 and 21 have a smaller spacing distance therebetween so that the hair can be easily sectioned off at the front end portions thereof. However, a larger spacing distance exists between the curved parts 11-1 and 22-1 at a rear end portion thereof due to the presence of the brackets 11-3 and 21-3 so that grip strength at the rear end portion is weak.

Therefore, the hair selected to be clipped may fall off from the hair clip and easily become tangled.

As a result, a user may experience difficulties in styling or coloring a hair and may need to use an additional hair clip to prevent such problem.

In addition, since the hair clip is made of synthetic resins, i.e., plastic, a bent mark may be left on the hair after hair styling.

FIG. 2 illustrates a conventional hair clip that attempts to resolve such problems described above.

The hair clip 1 includes a pair of clip pieces 2 and 3 facing each other, a pressing plate 2*a* and 3*a* formed integrally with the clip pieces 2 and 3, respectively, brackets 2*b* and 3*b* formed at edges of the pressing plates 2*a* and 3*a*, and a hinge pin 1*p* to be inserted into pin holes 2*h* and 3*h* of the brackets 2*b* and 3*b* for connecting the clip pieces together.

The hair clip 1 also has a coil spring 1*s* inserted into the hinge pin 1*p* to provide elastic force for opening and closing the clip pieces 2 and 3. The aforementioned structure represents a basic configuration of a hair clip in general.

In addition to the above known structure, the conventional hair clip 1 includes a finger 4 connected to a free end 2*e* of the upper clip piece 2. The length of the upper clip piece 2 is shortened by the length of the finger 4 compared with the length of the lower clip piece 3.

The finger 4 is connected to the upper clip piece 2 by insertion of a pin 2*p* with a coil spring into the pin holes 2*h*' of the brackets 2*d* formed at the free end 2*e* portion of the upper clip piece 2 and into the pin holes 4*h* formed in the finger 4.

The finger 4 is therefore pivoted with respect to the upper clip piece 2. At a Y-shaped diverging rear end portion 4*b* of the finger 4 is a guide loop 5 connected by a connecting means to prevent the hair from entering the gap in the joint portion L of the finger 4.

The rear end 5*b* of the square-bent guide loop 5 is supported when arranged in certain positions in the hair clip 1. Further, teeth 4*t* in a wave form are formed at the edges on both sides of the bottom portion of the finger 4 for use in holding hair.

The upper clip piece 2 has a laterally extending hold eye 2*g* on the side of upper clip piece 2, the hold eye 2*g* being positioned close to the brackets 2*b* for the insertion of the guide loop 5. A concavity portion 2*c* is formed at the bottom of the upper clip piece 2 to secure a hair clipping space. The remainder of the bottom portion has teeth 2*t* in a wave form to hold the hair of the user.

The lower clip piece 3 is in a narrow, long form, and slightly curves in the longitudinal direction. The lower clip piece 3 is brought into contact with the end 4*a* of the finger 4 at its fore end portion.

As a means to connect the guide loop 5 to the rear end portion 4*b* of the finger 4, partially cut-open pin holes 4*g* are provided.

The partially cut-open pin holes 4*g* are at the Y-shape diverging rear end portion 4*b* of the finger 4. At the connecting portion 5*a* on either side of the guide loop 5 is a U-shaped indent 5*u* into which the rear end portion 4*b* of the finger 4 is inserted.

A pin 5*p* is provided in the indent 5*u* in an integral form. The pins 5*p* are pushed into the pin holes 4*g* at the rear end portion 4*b* of the finger 4 through the cut-open portion of the pin holes 4*g*. In this manner, the pins 5*p* are connected smoothly with the pin holes 4*g* by the elasticity of the material of the finger 4. After the connection, the connecting portions 5*a* of the guide loop 5 do not fall off the rear end portion 4*b* of the finger 4 unless manual force is applied to separate them.

In the hair clip described above, when a hair is clipped, the hair is secured by the connecting portions 5*a*, thereby pivoting the hair clip. Accordingly, the upper clip piece 2 as well as the finger 4 engaged with the connecting portions 5*a* are pivoted to secure the hair.

The pivoted finger 4 prevents the hair from falling off from the hair clip. However, the finger 4 of the hair clip described above is configured to be movable so that, in case of a customer having a scarce hair, the hair may fall off from one side of the hair clip and thus may not be securely held.

Also, the hair clip has a structure in which multiple components are connected via a hinge connection. Such structure adds complexity and cost to the manufacture process.

Further, since multiple components are interconnected to operate, if one component is defective, the whole device may become inoperable.

Another hair clip is illustrated in FIG. 3. The hair clip of FIG. 3 includes an upper clip 10, a finger member 20, a pressing member 30, a variable spring 40 and a lower clip 50. The upper clip 10 includes a first curved part 11, having hinge holes 11*a* positioned on both sides of the first curved part 11, spring support holes 11*b* positioned in a longitudinal direction of the first curved part 11, a pressing plate 12 on which a protrusion 12*a* is formed, and a bracket 13 having connection holes 13*a* on both side portions thereof. The finger member 20 includes support holes 22 on both side portions thereof, the finger member 20 being pivotable about a fixed axis 21 by being inserted into the hinge holes 11*a* of the upper clip 10. The pressing unit 30 includes a support protrusion 31 formed on one end thereof, which is inserted into the support holes 22 of the finger member 20, and a support step 32 formed on the other end thereof, which is guided into a lower portion of the protrusion 12*a* of the upper clip 10. The pressing unit 30 further includes a plurality of support units 33 formed on a bottom side thereof in a longitudinal direction to hold the hair. The variable spring 40 has both end portions that are engaged with the support holes 11*b* of the upper clip 10 and a square-bent portion of the variable spring 40 is positioned closely to a lower portion of the finger member 20 to provide elasticity to the finger member 20 when the finger member 20 is pivoted, depending on an amount of a clipped hair. The lower clip 50 includes a second curved part 51 having a curvature with respect to the pressing unit 30 in correspondence with the upper clip 10. The lower clip 50 further includes a torsion spring S formed on one side of the second curved part 51 so that the bracket 13 of the upper clip 10 is pivotable with respect to the torsion spring S. Also, the lower clip 50 includes a bracket 52 having a connection hole 52*a* to which a rivet R is inserted and a supporting plate 53 corresponding to the pressing plate 12 of the upper clip 10 that is formed on one end of the lower clip 50.

However, in the hair clip described above, the finger 4 is configured to be movable so that, in case of a customer having a scarce hair, the hair may fall off from one side of the hair clip. Therefore, it may be difficult to firmly hold the hair.

In addition, since the hair clip has a structure in which the variable spring 40, which is engaged with the finger member 20, pushes the finger member 20 upwardly, one ends of the upper and the lower clips are not attached sufficiently close to each other, thereby causing the hair falling away from one side of the hair clip.

Also, the hair clip has a structure in which multiple components are connected via a hinge connection. Such structure adds complexity and cost to the manufacture process.

Further, since multiple components are interconnected to operate, if one component is defective, the whole device may become inoperable.

Still further, in order to section off the hair, the upper and lower clips need to be separated in order to use a front end portion of the lower clip in sectioning off the hair, which causes great inconvenience.

Still further, since the spring positioned between the upper and lower clips is brought into a direct contact with the hair, if the spring rusts, it may stain the hair.

Still further, since the supporting piece 33 is formed on the pressing member 30, a hair is pressed against by the supporting piece 33 and becomes bent.

SUMMARY OF THE INVENTION

The present invention has been made in view of the above problems, and it is an objective of the present invention to provide a hair clip for holding or retaining a strand of a hair in a particular style, wherein the hair clip has an improved structure in which a separated hair is securely placed in held so that the hair may not easily fall off from the hair clip, thereby facilitating hair styling.

Also, by using an elastic fixing member, the hair clip may not leave a mark thereof on the hair after the hair styling.

Further, by extending a lower clip, the hair may be easily sectioned off without a need to separate upper and lower clips.

In accordance with an aspect of the present invention, a hair clip includes an upper clip configured to be pivoted on a hinge by a spring to press downward on a hair, the upper clip including a first body having a receiving unit that provides a space for a fixing member to expand, a first pressing unit positioned on one end of the first body, the first pressing unit configured to separate the upper clip and a lower clip when pressed, and a first bracket having a first through hole, the first bracket being positioned on a lower portion of the first pressing unit so that the first pressing unit is connected with the lower clip through the hinge; the lower clip configured to support the hair when the hair is laid on the lower clip to be clipped, the lower clip including a second body bent in correspondence with a curvature of a head portion of the first body of the upper clip, which is attached closely thereto, a second pressing unit positioned on one end of the second body of the lower clip, the second pressing unit being configured to separate the upper clip and the lower clip when a clamping force is applied thereto, and a second bracket having a second through hole, the second bracket being positioned on an upper portion of the second pressing unit of the lower clip so that the second pressing unit of the lower clip is connected with the upper clip through the hinge; a fixing member having an elasticity and configured to hold the hair, the fixing member having a first end coupled with the first body of the upper clip and a second end coupled with the first pressing unit of the upper clip; the spring configured to provide an elastic force while pressing the upper clip; and the hinge configured to connect the upper and lower clips with the spring so that the upper and lower clips are pivotable about the hinge.

In one example embodiment, the hair clip may further include a collecting projection to collect the hair that is sectioned off by using the lower clip.

In one example embodiment, the hair clip may further include an extension unit configured to have an oval shape to prevent any damage to a scalp while sectioning off the hair, wherein the extension unit has a step formed on one end thereof to receive one end of the upper clip, thereby preventing the hair from entering a joint area when sectioning off the hair.

In one example embodiment, the hair clip may further include an elastic member positioned on an upper portion of the lower clip to firmly hold the hair in association with the fixing member.

In one example embodiment, the fixing member may be pressed against the hair to hold the hair while being spaced apart from the receiving unit of the upper clip by a predetermined interval, and wherein a first end of the fixing member is engaged with a lower portion of one end of the first body of the upper clip and a second end of the fixing member is engaged with the first pressing unit of the upper unit, while surrounding a lower circumference of the spring.

In one example embodiment, the fixing member may be opened together with the upper clip and, when closed, be positioned on the hair to be clipped, the fixing member being expandable depending on an amount of the hair to be clipped while the fixing member arcs across the hair.

In one example embodiment, the fixing member may include a protrusion formed on both ends thereof to be insertable within a groove.

BRIEF DESCRIPTION OF THE DRAWINGS

The objects, features and advantages of the present invention will be more apparent from the following detailed description in conjunction with the accompanying drawings, in which.

DETAILED DESCRIPTION OF EXEMPLARY EMBODIMENTS

Various example embodiments will now be described more fully with reference to the accompanying drawings in which only some example embodiments are shown. Detailed descriptions of well-known functions and structures incorporated herein may be omitted to avoid obscuring the subject matter of the present invention. Specific structural and functional details disclosed herein are merely representative for purposes of describing example embodiments. The present invention, however, may be embodied in many alternate forms and should not be construed as limited to only the example embodiments set forth herein. Accordingly, example embodiments are to cover all modifications, equivalents, and alternatives falling within the scope of the invention.

Figure 1:
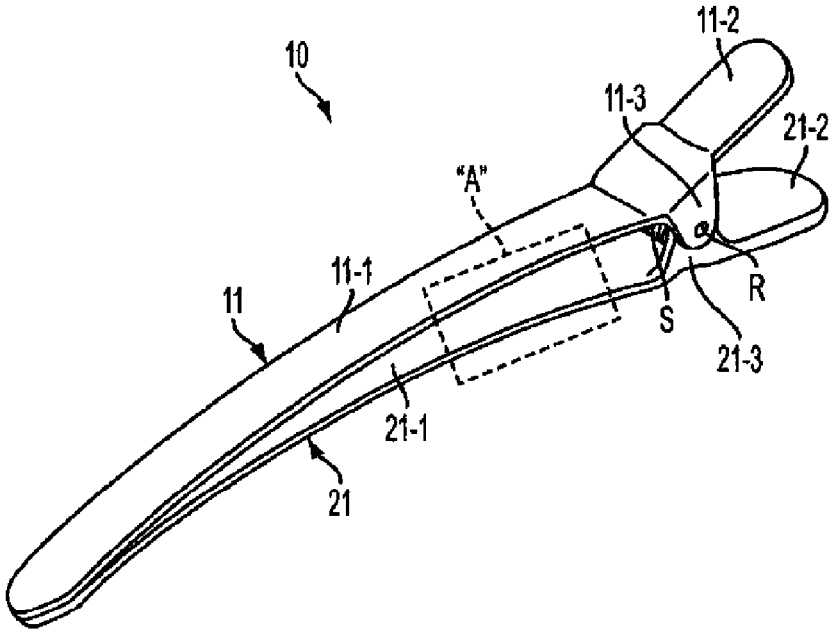
PRIOR ART FIG. 1
FIGS. 1 through 3 are schematic views illustrating a conventional hair clip.
Figure 2A:
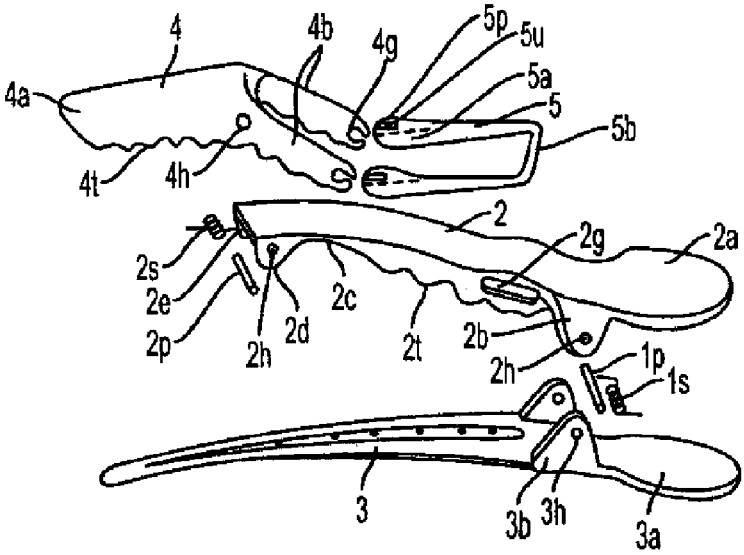
PRIOR ART FIG. 2A
Figure 2B:
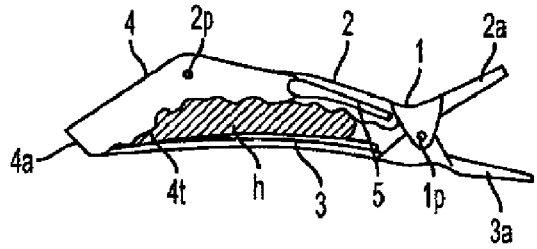
PRIOR ART FIG. 2B
Figure 3:
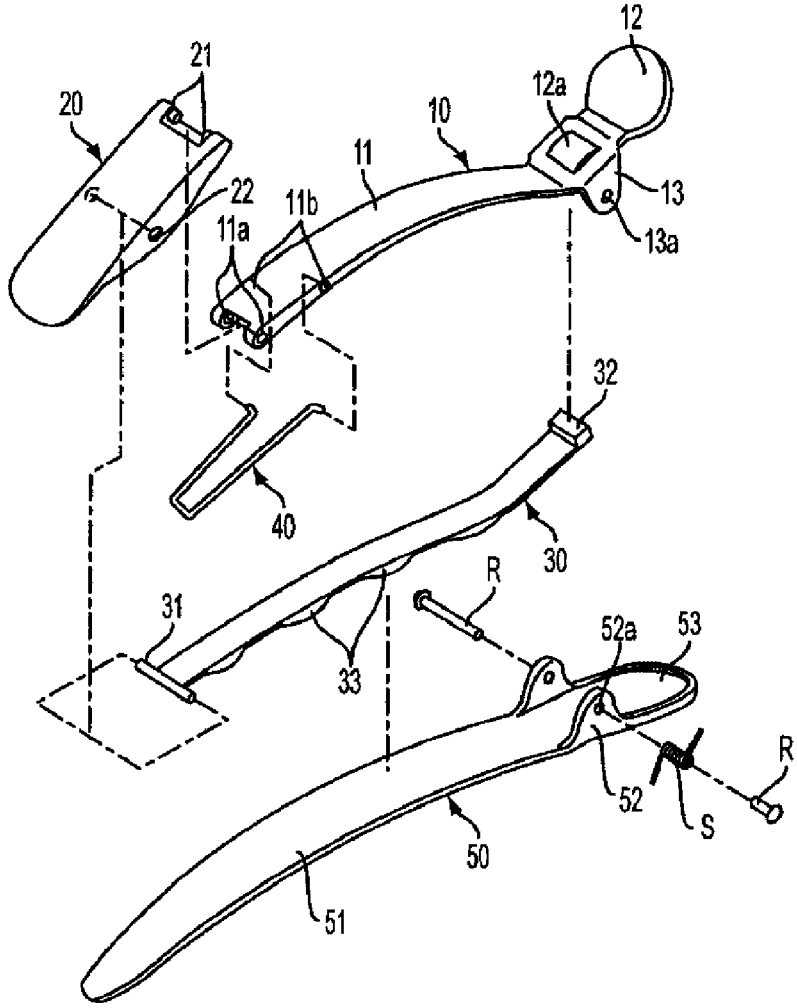
PRIOR ART FIG. 3
Figure 4:
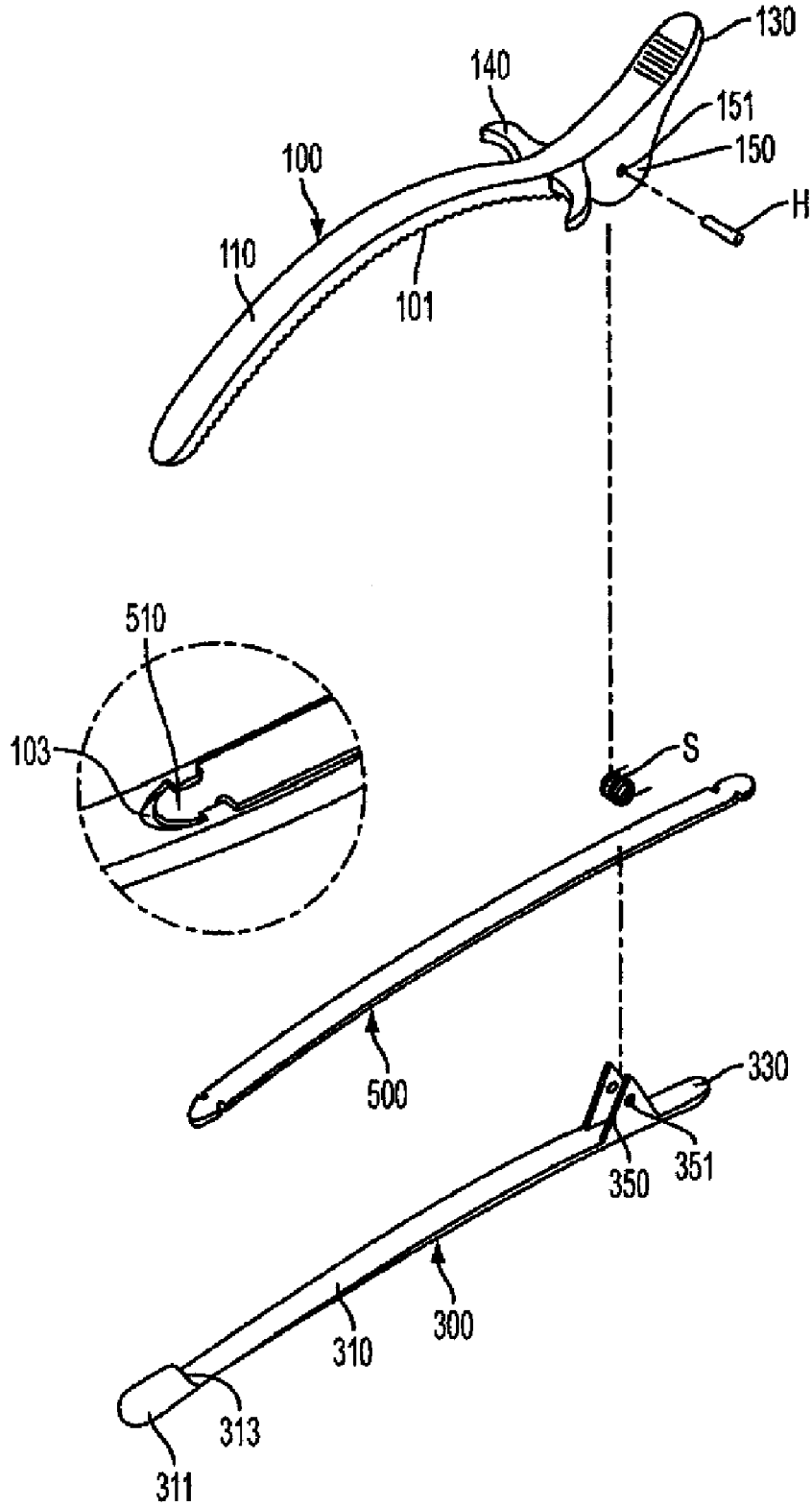
FIG. 4 is an exploded perspective view illustrating a hair clip according to one example embodiment of the present invention.
Figure 5:
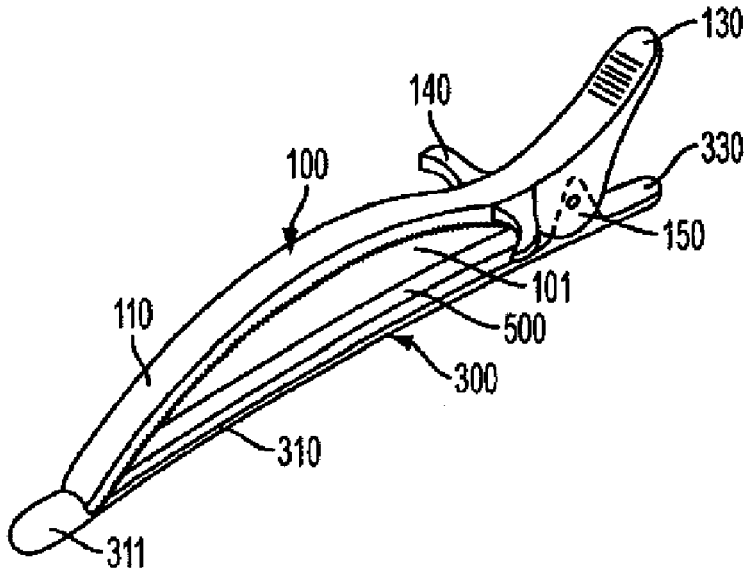
FIG. 5 is an assembled perspective view illustrating a hair clip according to one example embodiment of the present invention.
Figure 6:
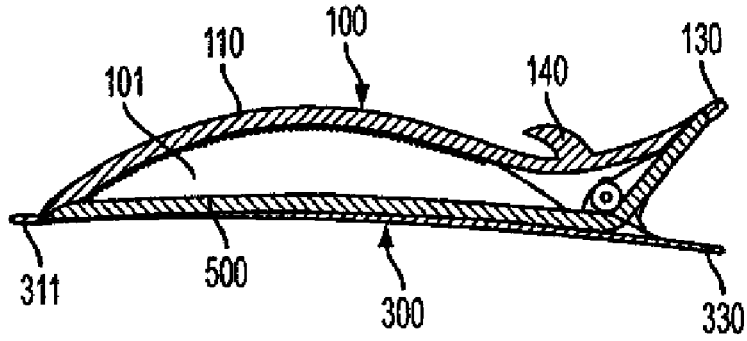
FIG. 6 is a cross-sectional view illustrating a hair clip according to one example embodiment of the present invention.
Figure 7A:
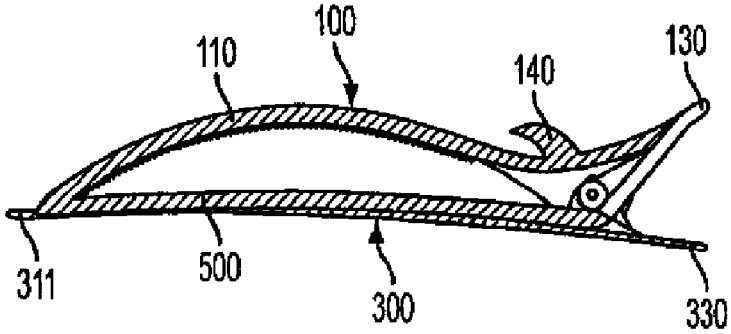
FIGS. 7A through 8 are views illustrating a hair clip according to another example embodiment of the present invention.
Figure 7B:
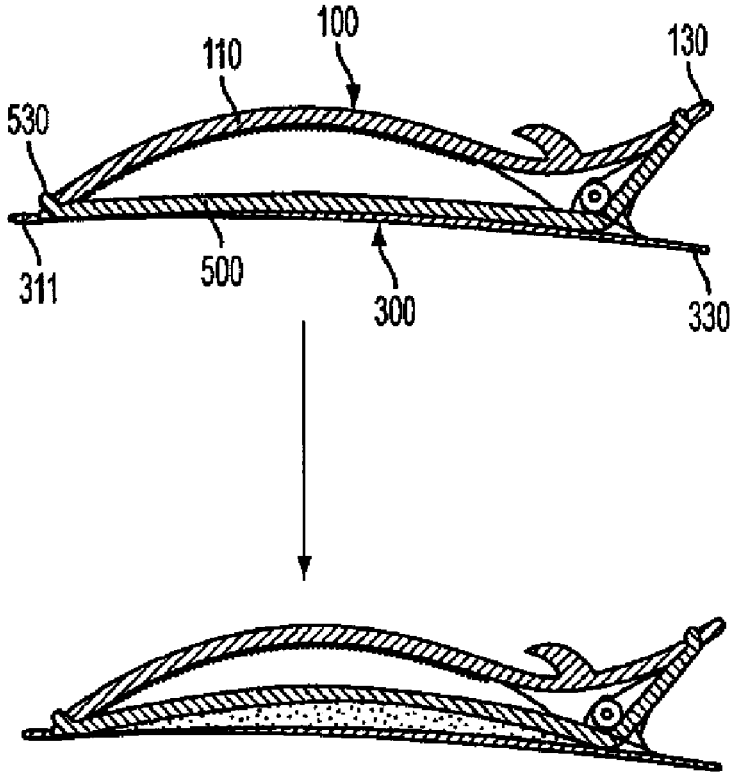
Figure 7C:
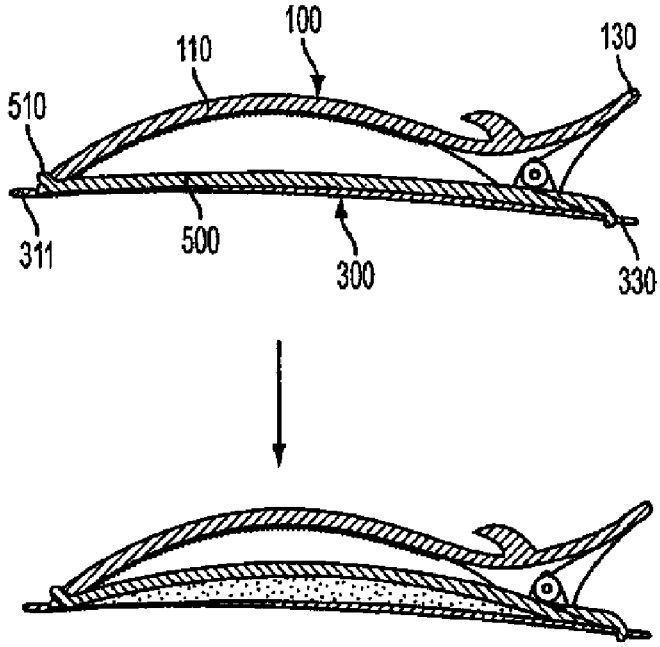
Figure 7D:
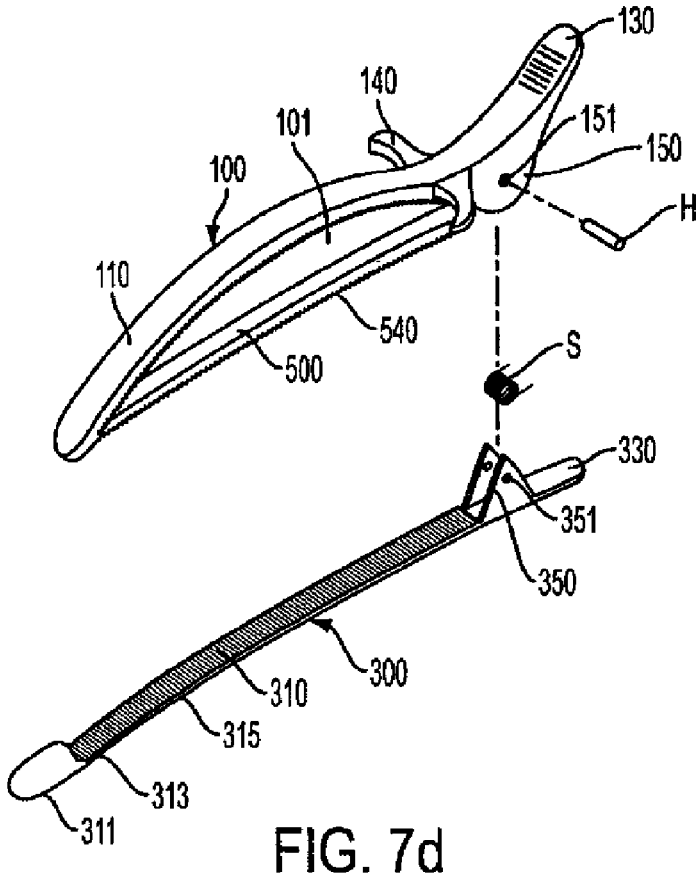
Figure 8:
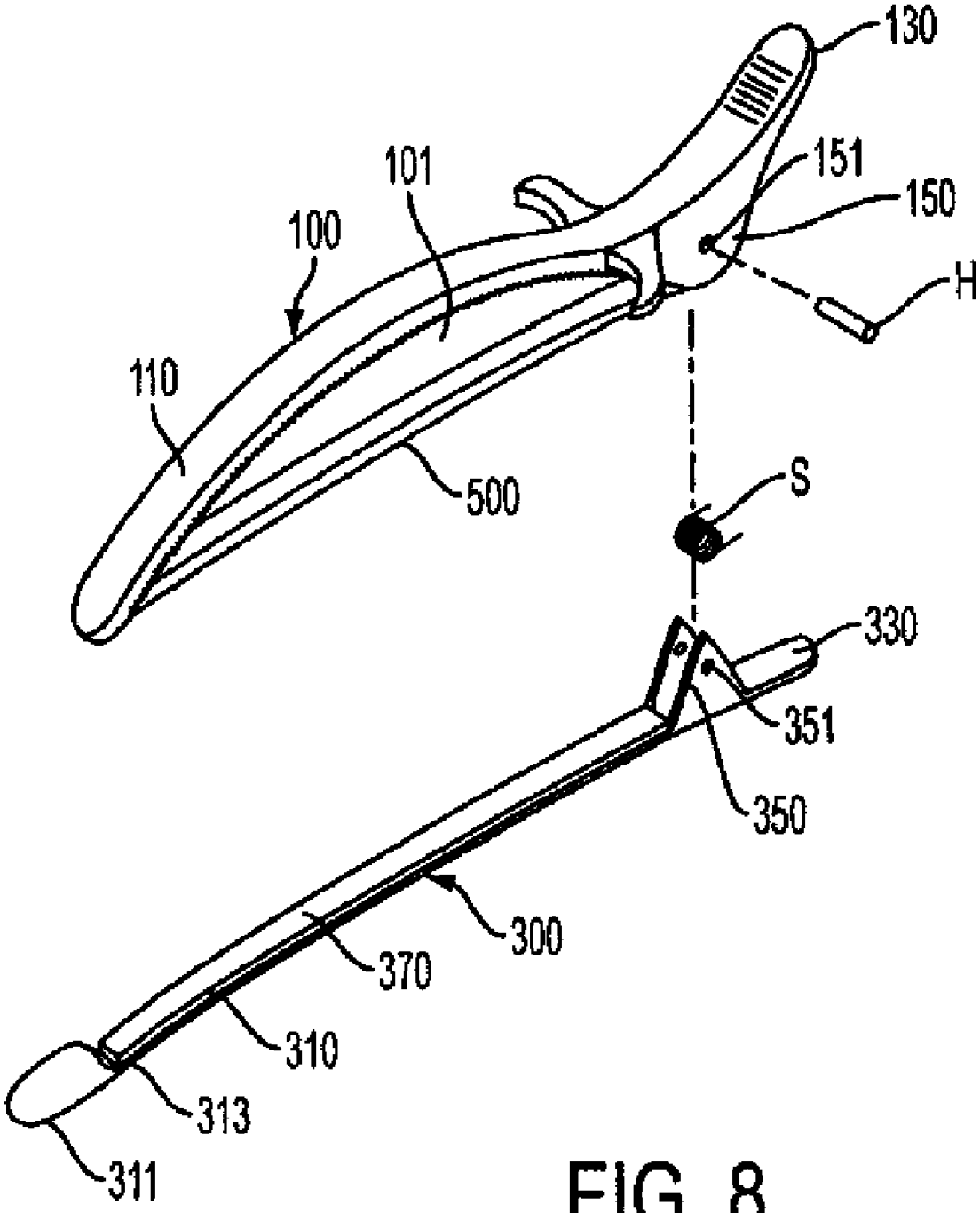

FIG. 4 is an exploded perspective view illustrating a hair clip according to one example embodiment of the present invention, FIG. 5 is an assembled perspective view illustrating a hair clip according to one example embodiment of the present invention, FIG. 6 is a cross-sectional view illustrating a hair clip according to one example embodiment of the present invention and FIGS. 7A through 8 are views illustrating a hair clip according to another example embodiment of the present invention.

According to the present invention, a hair clip includes an upper clip 100 for fixing a hair when pressed downward against the hair, a lower clip 300 for supporting the upper clip 100 when pressed and a fixing member 500 for securely fixing the hair, wherein the hair to be clipped is laid on the lower clip 300.

The upper clip 100 is pivoted on a hinge H by a spring S and pressed downward to secure the hair. The upper clip 100 includes a body 110 which is formed to have an arch shape so that the body has a receiving unit 101 for providing a space that allows the fixing member 500 to expand.

By forming the body 110 in the arch shape, a first end portion of the body 110 can be attached closely to the lower clip 300 so that a clipped hair is prevented from falling off.

A pressing unit 130 is positioned on a second end portion of the body 110. When pressed, the pressing unit 130 separates the upper clip 100 and the lower clip 300.

A bracket 150 having a through hole 151 is formed on a lower portion of the pressing unit 130 so that the pressing unit 130 is connected with the lower clip 300 through the hinge H.

The pressing unit 130 includes a collecting projection 140 to collect the hair that is sectioned off by using the lower clip 300, which is further described below.

The collected hair is fixed by the clip.

The lower clip 300 supports the hair when the hair to be clipped is laid thereon. The lower clip 300 includes a body 310 that is bent in correspondence with the curvature of a head portion of the body 110 of the upper clip 100, which is attached closely thereto.

The body 310 includes an extension unit 311 that is extended to be longer than the body 110 of the upper clip 100 so that the hair may be easily sectioned off. Namely, in the prior art technique, the upper and lower clips need to be separated first so that the hair is sectioned off by using the lower clip; however, according to the present invention, the hair can be sectioned off by using the extension unit 311, thereby obviating the need to separate the upper and lower clips.

The extension unit 311 is formed to have an oval shape to prevent any damage to a scalp while sectioning off the hair. A step 313 is formed on one end of the extension unit 311 which receives one end of the upper clip 100, thereby preventing the hair from entering a joint area when sectioning off the hair.

A pressing unit 330, which corresponds to the pressing unit 130 of the upper clip 100, is positioned on one end of the body 310 of the lower clip 300. The pressing unit 330, together with the pressing unit 130, is used to open the upper clip 100 when a clamping force is applied thereto.

A bracket 350 including a through hole 351 is formed on an upper portion of the pressing unit 330 so that the pressing unit 330 is connected with the upper clip 100 through the hinge H.

In this case, as illustrated in FIG. 8, an elastic member 370 may be positioned on an upper portion of the body 310 of the lower clip 300 to hold the hair more firmly.

The elastic member 370 can be formed integrally or separably with/from the lower clip 300.

The fixing member 500 is pressed against the hair to hold the hair. The fixing member 500 is spaced apart from the receiving unit 101 of the upper clip 100 by a predetermined interval and is engaged with a lower portion of one end of the body 110 of the upper clip 100. Also, the fixing member 500 is engaged with the pressing unit 130 of the upper unit 100 by using a circular protrusion 510 to firmly hold the hair. One end of the fixing member 500 is engaged with the pressing unit 130, while surrounding a lower circumference of the spring S.

In this way, increased elastic force is provided when separating the upper clip 100 and the lower clip 300 so that the hair can be held in place more securely. In addition, when rust is generated in the metal spring, the hair may be prevented from being stained by the rust.

The fixing member 500 is formed with an elastic material such as silicon or rubber.

As shown in FIG. 4, a groove 103 is formed on the upper clip 100 and a protrusion 510 is formed on the fixing member 500 so that the fixing member 500 is engaged with the upper clip 100 by inserting the protrusion 510 into the groove 103. Therefore, when the fixing member 500 is worn out by, for example, a perm product, or the elasticity of the fixing member 500 is decreased, the fixing member 500 can be replaced. Also, in one example embodiment as shown in FIG. 7A, the fixing member 500 may be formed in one body with the upper clip 100. Further, in one example embodiment as shown in FIG. 7B, a groove may be formed on the upper clip 100 and a rod 530 may be formed on the fixing member 500 at both ends so that the rod 530 of the fixing member 500 is inserted to the groove. Still further, in one example embodiment as shown in FIG. 7C, one end of the fixing member 500 can be engaged with the body 110 of the upper clip 100 at a first end thereof and engaged with the pressing unit 130 of the lower clip 300 at a second end thereof. Still further, in one example embodiment as shown in FIG. 7D, saw-like protrusions 315 and 540 may be formed on a bottom side of the fixing member 500 and a top side of the lower clip 300, respectively, to firmly hold the hair to be clipped.

The fixing member 500 is opened together with the upper clip 100 and, when closed, the fixing member 500 is laid on the hair to be clipped. The fixing member 500 can expand depending on an amount of the hair to be clipped while the fixing member 500 arcs across the hair.

Since the fixing member 500 has elasticity, the fixing member 500 may not leave any mark on the hair that is clipped.

In addition, when holding a thin and scarce hair, hair may be held smoothly by using the elasticity of the fixing member 500 so that the hair may not be bent or tangled with the clip during the use of the hair clip.

Hereinafter, with reference to the drawings, an operation of the present invention is described.

Figure 9:
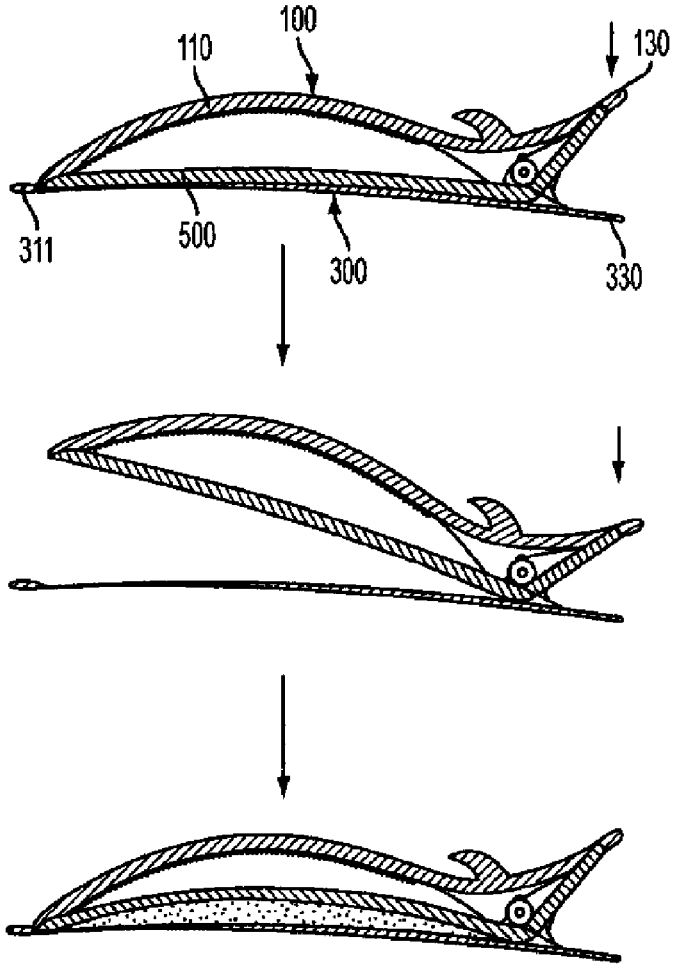
FIGS. 9 through 11 are views illustrating an operation mechanism of a hair clip according to one example embodiment of the present invention.
Figure 10:
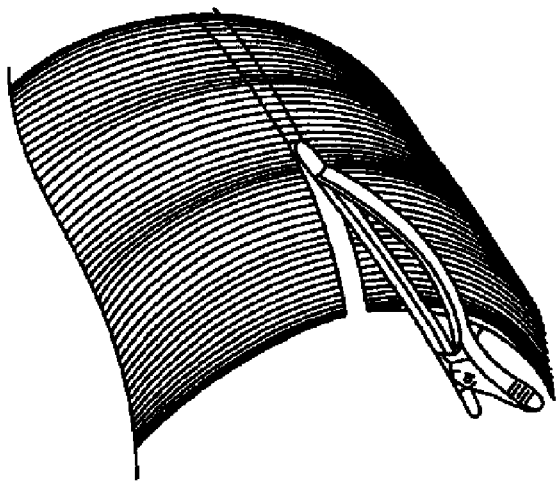
Figure 11:
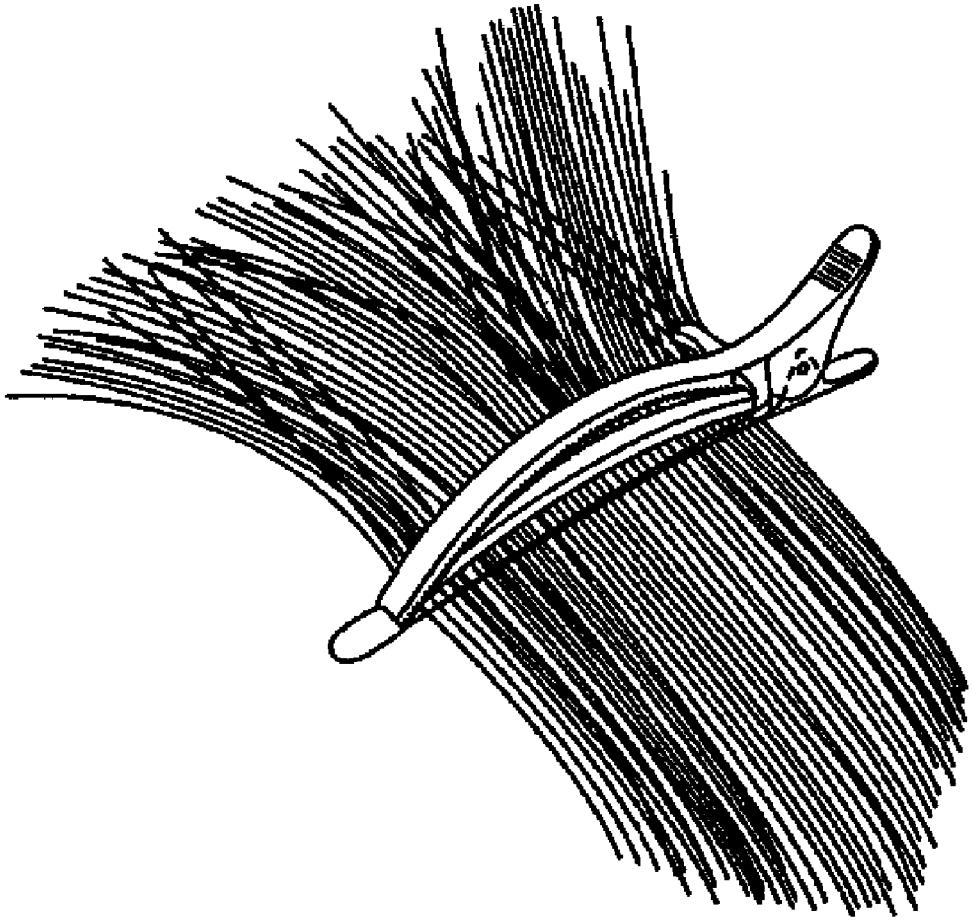

FIGS. 9 through 11 are cross-sectional views illustrating an operation mechanism of a hair clip according to one example embodiment of the present invention.

The fixing member is formed integrally or separately to/from the upper clip 100 and the upper clip 100 is engaged with the lower clip 300 and the spring S through the hinge H.

When performing hair care or hair perm by using the hair clip, the pressing units 130 and 330 are pressed to separate the upper and lower clips 100 and 300.

When the hair to be clipped is placed between the upper and lower clips 100 and 300, the upper clip 100 is released and pivoted about the hinge H by the elasticity of the spring S to return to a closed position, thereby clipping the hair.

Here, referring to FIG. 10, the fixing member 500 of the upper clip 100 having elasticity is pivoted together with the upper clip 100 and placed on top of the hair, thereby pressing the hair. Therefore, the hair can be firmly held (see FIG. 9).

Also, the extension unit 311 may be used to section off the hair, which obviates the need to separate the pressing units 130 and 330 of the upper and lower clips 100 and 300 (see FIG. 10).

Although exemplary embodiments of the present invention have been described in detail hereinabove, it should be clearly understood that many variations and modifications of the basic inventive concepts herein taught which may appear to those skilled in the present art will still fall within the spirit and scope of the present invention, as defined in the appended claims.

What is claimed is:

1. A hair clip comprising:

an upper clip configured to be pivoted on a hinge by a spring to press downward on a hair, the upper clip including a first body having a receiving unit that provides a space for a fixing member to expand, a first pressing unit positioned on one end of the first body, the first pressing unit configured to separate the upper clip and a lower clip when pressed, and a first bracket having a first through hole, the first bracket being positioned on a lower portion of the first pressing unit so that the first pressing unit is connected with the lower clip through the hinge;

the lower clip configured to support the hair when the hair is laid on the lower clip to be clipped, the lower clip including a second body bent in correspondence with a curvature of a head portion of the first body of the upper clip, which is attached closely thereto, a second pressing unit positioned on one end of the second body of the lower clip, the second pressing unit being configured to separate the upper clip and the lower clip when a clamping force is applied thereto, and a second bracket having a second through hole, the second bracket being positioned on an upper portion of the second pressing unit of the lower clip so that the second pressing unit of the lower clip is connected with the upper clip through the hinge;

the fixing member having an elasticity and configured to hold the hair, the fixing member having a first end coupled with the first body of the upper clip and a second end coupled with the first pressing unit of the upper clip;

the spring configured to provide an elastic force while pressing the upper clip;

the hinge configured to connect the upper and lower clips with the spring so that the upper and lower clips are pivotable about the hinge; and an extension unit configured to extend from the lower clip by a predetermined length sufficient to section off the hair and having an oval shape to prevent any damage to a scalp while sectioning off the hair, wherein the extension unit has a step formed at a joint area among the upper clip, the lower clip and the extension unit, thereby one endmost part of the upper clip of the upper clip being coupled at the joint area when the hair clip is in a closed position such that the hair is prevented from entering the joint area.

2. The hair clip according to claim 1, further comprising a collecting projection to collect the hair that is sectioned off by using the lower clip.

3. The hair clip according to claim 1, further comprising an elastic member positioned on an upper portion of the lower clip to firmly hold the hair in association with the fixing member.

4. The hair clip according to claim 1, wherein the fixing member is pressed against the hair to hold the hair while being spaced apart from the receiving unit of the upper clip by a predetermined interval, and wherein a first end of the fixing member is engaged with a lower portion of one end of the first body of the upper clip and a second end of the fixing member is engaged with the first pressing unit of the upper unit, while surrounding a lower circumference of the spring.

5. The hair clip according to claim 1, wherein the fixing member is opened together with the upper clip and, when closed, is positioned on the hair to be clipped, the fixing member being expandable depending on an amount of the hair to be clipped while the fixing member arcs across the hair.

6. The hair clip according to claim 1, wherein the fixing member includes a protrusion formed on both ends thereof to be insertable within a groove.

* * * * *